United States Patent [19]

Brown et al.

[11] 4,320,957

[45] Mar. 23, 1982

[54] CORONA WIRE ADJUSTER

[75] Inventors: Leon C. Brown; Stanley L. Pond, both of Boulder, Colo.

[73] Assignee: International Business Machines Corp., Armonk, N.Y.

[21] Appl. No.: 154,734

[22] Filed: May 30, 1980

[51] Int. Cl.[3] ..... G03G 15/02; H01T 19/04

[52] U.S. Cl. ..... 355/3 CH; 250/324; 250/326; 361/225; 361/230

[58] Field of Search ..... 355/3 R, 3 CH; 250/324, 250/325, 326; 361/225, 229, 230

[56] References Cited

U.S. PATENT DOCUMENTS

| | | | |
|---|---|---|---|
| 3,499,143 | 3/1970 | Martin | 250/324 |
| 3,922,548 | 11/1975 | Honda | 250/324 |
| 3,967,119 | 6/1976 | Matsumoto | 250/326 |
| 4,089,600 | 5/1978 | Ito et al. | 355/3 CH |
| 4,099,219 | 7/1978 | Laing | 361/230 |
| 4,112,298 | 9/1978 | Weikel | 250/326 X |
| 4,203,144 | 5/1980 | Okamoto | 355/3 CH X |
| 4,252,431 | 2/1981 | Cormier | 355/3 CH |

OTHER PUBLICATIONS

Gilliver, D.; "Corotron Wire Tensioner"; Xerox Disclosure Journal, vol. 4, No. 5, Sep./Oct. 1979; p. 605.

*Primary Examiner*—Fred L. Braun

*Attorney, Agent, or Firm*—Mitchell S. Bigel; E. C. Hancock; J. Jancin, Jr.

[57] ABSTRACT

A corona wire, either directly or through an auxiliary element, engages the spiral thread of a screw-like stub member mounted on the housing of a corona charging apparatus to provide a simple, low cost and easily assembled corona wire adjuster. The stub member is mounted on the housing such that it may be rotationally driven much like a screw, but, unlike a screw, will not move into or out of the housing as it is rotated. Rotation of the stub member causes the corona wire to move in a direction parallel to the stub member axis in response to the thread engagement and thereby change its position relative to a photoconductor surface.

16 Claims, 3 Drawing Figures

CORONA WIRE ADJUSTER

DESCRIPTION

TECHNICAL FIELD

This invention generally relates to a corona charging apparatus of the type used in electrophotographic copiers, and more particularly to an adjusting mechanism therefor.

It is well known that electrophotographic copiers comprise a photoconductive surface which is initially charged uniformly by a corona charging apparatus, and then exposed to a light pattern representing the image to be copied. This produces a latent electrostatic image on the photoconductive surface. The image is next developed and then transferred to paper where the transfer is fixed to render the copy permanent. In addition to the precharging function, a corona charging apparatus is often used for the transfer operation, and photoconductive surface cleaning function. Typically, a corona charging apparatus comprises an elongated housing having a corona bay therein, and a corona wire or wires within the bay.

In order to obtain high quality copies, it is essential that the corona charging apparatus uniformly charge the photoconductive surface at a suitable voltage level. A major cause of nonuniform charge is variation in the distance between the photoconductive surface and the corona wire within the corona charging apparatus. Such variation is due to a number of factors including a change in the positions of parts with use.

In order to obtain consistently high quality copies, a corona wire adjuster has been devised for adjusting the position of the corona wire relative to the photoconductive surface. It is simple to adjust, fabricated of a single low cost part, and easily incorporated into a corona charging apparatus.

BACKGROUND ART

Many corona charging units of the prior art are fixedly mounted so that no adjustment of the corona wire is possible. Other arrangements include mounting hardware for the corona housing wherein the entire housing is moveable to adjust the wire relative to the photoconductive surface. The housing in such latter arrangements limits the span of adjustment available. In addition, it is frequently important that the corona housing remain in a relatively fixed position to minimize contamination of the corona by toner particles, dust or the like, which can be defeated by requiring adjustment of the entire housing. Still further, many contemporary corona units include multiple corona wires within a common housing so that adjustment of a housing position for one wire is not likely to result in an ideal adjustment for other wires in that same housing.

Still other prior art corona devices have been developed for the purpose of allowing wire adjustment without moving the housing. For instance, U.S. Pat. No. 4,089,600 to Ito et al describes a corona wire adjuster which employs a set screw threaded through one leg of an L-shaped member, the other leg of which has a notch which engages the corona wire. Turning the set screw moves the L-shaped member, and the engaged corona wire. This corona wire adjuster requires at least two parts (i.e., the set screw and the L-shaped member) and requires their alignment before assembly in the corona charging apparatus. Further, the set screw must be driven into its mounting, to a nominal or reference position, prior to adjusting the corona wire, and can only be moved one way from the nominal position.

Another corona wire adjuster allowing wire adjustment without moving the housing is described in U.S. Pat. No. 3,922,548 to Honda. It employs a corona wire mounted on a rail supported by leaf springs and movable by a pair of set screws. At least three parts (i.e., the rail, the set screws and the leaf springs) are required. For assembly these parts must be aligned and the set screws driven to a nominal or reference position.

DISCLOSURE OF INVENTION

It is a principle object of this invention to provide an improved corona wire adjuster.

Another object of the invention is to provide a corona wire adjuster that enables making a simple adjustment of a corona wire position relative to a photoconductive surface.

It is another object of the invention to provide a corona wire adjuster that allows corona wire adjustment without moving the corona wire housing.

It is another object of the invention to provide a corona wire adjuster made of low cost parts.

It is a further object of the invention to provide a corona wire adjuster employing a minimum number of parts.

It is still a further object of the invention to provide a corona wire adjuster which is easily assembled into the corona charging apparatus.

It is still a further object of the invention to provide a corona wire adjuster which does not employ a set screw which must be driven to a nominal position prior to adjusting the corona wire.

These and other objects are accomplished by providing a corona wire adjuster wherein the corona wire or an auxiliary element attached in extending relation to the corona wire directly engages the spiral thread of a screw-like stub member that is mounted on the housing of the corona charging apparatus. The stub member is mounted on the housing in a rotatable but otherwise fixed position, i.e., it may be rotationally driven much like a screw, but, unlike a screw, will not move into or out of the housing as it is rotated. Accordingly, when the stub member is rotated, the corona wire, or the auxiliary element attached thereto, rides the threads and moves generally parallel to the stub member axis towards or away from the photoconductive surface, depending upon the direction of stub member rotation.

It will be clear that by directly engaging the corona wire, or the auxiliary element attached thereto only a single part (i.e., the stub member itself) is required for corona wire adjustment. This single adjusting part extends through the corona housing in such a manner that it is easily accessible to the user without disturbing the position of the housing itself in its mounted location relative to other machine components.

Further, in the embodiment shown, the stub member may be made of low cost plastic material, and merely snapped into place in the housing. Since the stub member is mounted in a rotatable but otherwise fixed manner, it need not be driven to a nominal or reference position or otherwise aligned prior to adjusting the corona wire, as would be necessary with a set screw.

In a second embodiment, a pair of stub members at either end of the corona wire may be employed for more precise adjustment. The threads of a stub member may directly engage the corona wire itself, or may directly engage auxiliary elements attached to the end of the corona wire and serving other purposes in the corona charging apparatus.

BEST MODE FOR CARRYING OUT THE INVENTION

Figure 1:
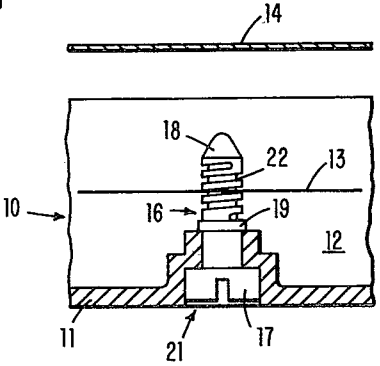
FIG. 1 is a cross-sectional view of a first embodiment of the corona wire adjuster of the invention.

As shown in FIG. 1, corona charging apparatus 10 comprises an elongated housing 11 (only a portion of which is shown), having a corona bay 12 therein. Corona wire 13 (only a portion of which is shown) extends substantially along the length of the bay. When suitably energized by means not shown, corona wire 13 emits ions which charge photoconductive surface 14. The corona wire adjuster of the subject invention promotes uniform charging by enabling adjustment of the corona wire, to vary the distance between corona wire 13 and photoconductive surface 14.

The corona wire adjuster employs a screw-like stub member 16, which includes a slotted head 17 and a shank 18 with a spiral thread 22 thereon and a circular lip 19, having a larger diameter than that of shank 18.

Stub member 16 is mounted on housing 11 in mounting hole 21 and retained in place axially by head 17 and lip 19 so that it may be rotated about its axis in response to force applied through a screwdriver or other appropriate tool, but without axial movement thereof relative to frame 11. The distance between head 17 and lip 19 is essentially the thickness of housing 11 at mounting hole 21. Since the diameter of shank 18 is substantially the diameter of mounting hole 21, once stub member 16 is snapped into place within mounting hole 21, it may be rotated within mounting hole 21 without vertical direction movement.

Stub member 16 may be made of a plastic material, by using a low cost moulding process. The design and fabrication of lip 19 is such as to permit snapping stub member 16 in place into mounting hole 21. This technique is well known to persons having ordinary skill in this art. Further, it will be understood that any means or technique may be employed to mount stub member 16 in housing 11 in a rotatable but otherwise fixed manner. For instance, lip 19 may be a snap-on washer or the like, separate from but attachable to stub member 16. Alternatively, spiral thread 22 may have a larger diameter than shank 18 and thus hold stub member 16 in place in mounting hole 21.

The position of mounting hole 21 relative to corona wire 13 and the dimensions of stub members 16 are such that its spiral thread 22 directly engages corona wire 13. When stub member 16 is rotated (by screwdriver or other suitable means), corona wire 13 rides thread 22 and moves axially along shank 18. Accordingly, corona wire 13 moves closer to or further from photoconductive surface 14 depending upon the direction of rotation of stub members 16.

It will be understood that the subject corona wire adjuster provides for simple screwdriver adjustment. Only a single part, i.e., member 16, is used, in FIG. 1, and this part may be inexpensively moulded of low cost plastic. Assembly is simple, with stub member 16 merely snapping into place at mounting hole 21. Adjustment to a nominal or reference position, as would be necessary with a set screw, is unnecessary.

Figure 2:
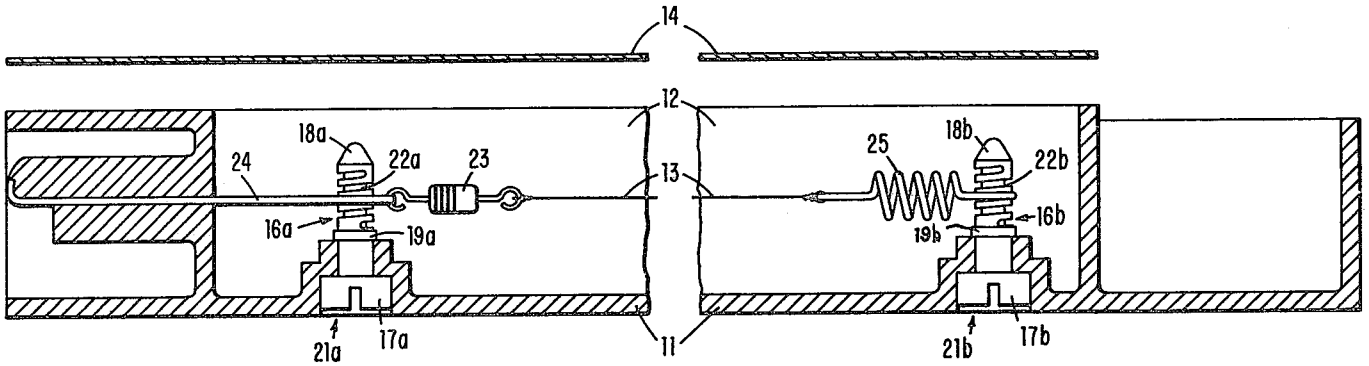
FIG. 2 is a cross-sectional view of a second embodiment of the corona wire adjuster of the invention.

The use of the corona wire adjuster of the subject invention in a second corona charging apparatus is illustrated in FIG. 2. A pair of stub members, 16*a* and 16*b*, are employed at opposite ends of housing 11. The configuration and mounting of each of the stub members 16*a* and 16*b* are exactly as described with regard to the stub member in FIG. 1. It will be noted that access to the slotted heads 17*a*, 17*b* of stub members 16*a*, 16*b*, respectively, is on the outside of housing 11, i.e., on that side of the housing not adjacent photoconductive surface 14. This avoids exposure of the user to high voltage of the corona wire and allows access to the corona wire adjuster without the necessity of moving housing 11.

In FIG. 2, the corona charging apparatus includes certain auxiliary elements which are attached to either end of corona wire 13 and which serve various purposes in the corona charging circuit. Auxiliary element 23, for example, is a resistor which establishes a level of current in corona wire 13. Auxiliary element 24 is a flexible elongated connector which connects corona wire 13 to a source of electrical power (not shown). Element 25 is a coil spring for maintaining corona wire 13 taut.

Rather than directly engaging corona wire 13, spiral threads 22*a* and 22*b* of stub members 16*a* and 16*b* directly engage auxiliary elements 24 and 25, respectively. For the purposes of engaging the stub member threads, auxiliary elements 24 and 25 merely act as physical extensions of the corona wire. It will be understood that operation of the corona wire adjuster is the same whether the threads engage the corona wire itself, or an extension thereof, as represented by an auxiliary element.

In FIG. 2, stub member 16*a* also serves as the terminating support for one end of corona wire 13, or the extension thereof represented by auxiliary element 25. This is accomplished by wrapping the end of auxiliary element 25 around shank 18*b*, in engagement with threads 22*b*. Stub member 16*b* thus serves to adjust corona wire 13 and also to support corona wire 13 within channel 12. Alternatively, a stub member may only be employed to adjust corona wire 13, as exemplified by stub member 16*a*. Separate support means for the corona wire must then be provided.

Figure 3:
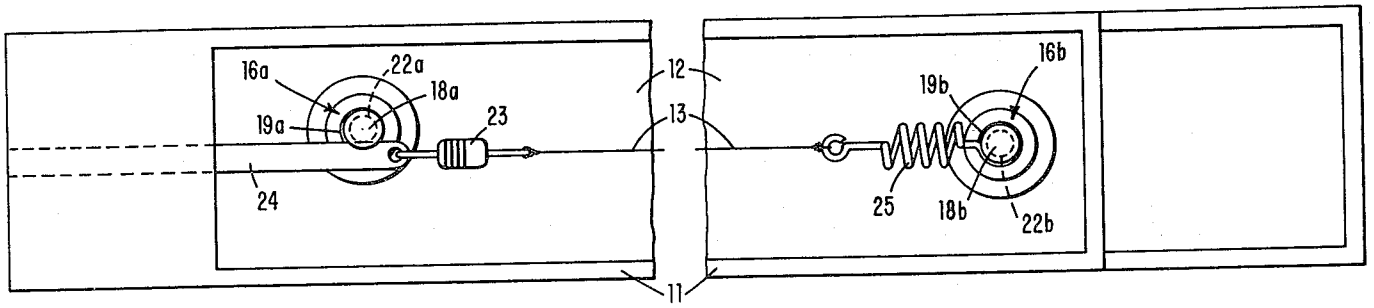
FIG. 3 is a top view of the embodiment of FIG. 2.

FIG. 3 is a top view of the embodiment of FIG. 2. For clarity, photoconductive surface 14 is not shown. It will be seen that stub members 16*a* and 16*b* are positioned differently in order to center the entire length of corona wire 13 within bay 12. Threads 19*a* of stub member 16*a* engage the side edge of flexible elongated connector 24. Stub member 16*a* is therefore positioned slightly off-center in bay 12. For stub member 16*b*, the end of spring 25 is wrapped around shank 18*b* in engagement with threads 19*b*. Stub member 16*b* is therefore centered in bay 12. By positioning stub member 16*a* slightly off-center, and centering stub member 16*b*, the entire length of corona wire 13 is centered within bay 12.

Various additions and/or modifications to the single corona bay structure shown and described in the exemplary preferred embodiment will be readily apparent to those having normal skill in the art. For instance, the corona charging apparatus can be structured with multiple side-by-side bays contained in a common housing with any or all of these bays having one or more corona wires positioned therein and including a corona wire adjuster of FIGS. 1–3. The corona bays can open directly toward the photoconductive surface or a grid screen or the like can be positioned across the bay opening between the corona wire and the photoconductive surface, or any combination can be used in a multiple bay corona arrangement. By way of further example, a multiple bay corona charging apparatus in accordance with this invention was built with three bays in a common housing, the center bay having two corona wires mounted therein while the adjoining bays each had a single wire. A control grid screen covered the center and one outer bay opening whereas the other outer bay opening was uncovered. As mentioned previously, the present invention is especially advantageous in a corona charging apparatus having multiple corona bays in a common housing in that the invention allows independent adjustment of each corona wire without disturbing the adjustment of any other corona wire within the housing.

Whereas we have illustrated and described the preferred embodiment of our invention, it is to be understood that we do not limit ourselves to the precise constructions herein disclosed and the right is reserved to all changes and modifications coming within the scope of the invention as defined in the appended claims.

We claim:

1. In a corona charging apparatus comprising an elongated housing having a corona bay therein, and a corona wire within said corona bay, apparatus for adjusting the position of said corona wire relative to said corona bay comprising:

a stub member, having a shank with a spiral thread thereon, and means for mounting said stub member on said housing, in a rotatable but otherwise fixed position, with said shank protruding into said corona bay and said thread engaging said corona wire, whereby rotation of said stub member causes said corona wire to ride said thread and move along said shank.

2. In a corona charging apparatus comprising an elongated housing having a corona bay therein, a corona wire within said corona bay, and an auxiliary element attached to one end of said corona wire, apparatus for adjusting the position of said corona wire relative to said corona bay comprising:

a stub member, having a shank with a spiral thread thereon, and means for mounting said stub member on said housing, in a rotatable but otherwise fixed position, with said shank protruding into said corona bay and said thread engaging said auxiliary element, whereby rotation of said stub member causes said auxiliary element to ride said thread and move along said shank.

3. In a corona charging apparatus comprising an elongated housing having a corona bay therein and a corona wire within said corona bay, apparatus for adjusting the position of said corona wire relative to said corona bay comprising:

first and second stub members, each having a shank with a spiral thread thereon, and first and second means for mounting said first and said second stub members, respectively, at opposite ends of said housing, in rotatable but otherwise fixed positions, with said shanks protruding into said corona bay, and said threads engaging opposite ends of said corona wire, whereby rotation of a stub member causes the associated end of said corona wire to ride the spiral thread of the stub member and move along said shank.

4. The corona charging apparatus of claim 3 wherein one end of said corona wire is wrapped around the threads of its associated stub member, whereby the stub member supports said one end of said corona wire within said corona bay.

5. In a corona charging apparatus comprising an elongated housing having a corona bay therein, a corona wire within said corona bay, and first and second auxiliary elements attached to opposite ends of said corona wire, apparatus for adjusting the position of said corona wire relative to said corona bay comprising:

first and second stub members each having a shank with a spiral thread thereon, and;

first and second means for mounting said first and said second stub members, respectively, at opposite ends of said housing, in rotatable but otherwise fixed positions, with said shanks protruding into said corona bay and said spiral thread engaging said first and second auxiliary elements, respectively, whereby rotation of a stub member causes the associated auxilary element to ride said thread and move along said shank.

6. The corona charging apparatus of claim 5 wherein said first auxiliary element is wrapped around the threads of said first stub member, whereby said first stub member supports said first auxiliary element within said corona bay.

7. A corona charging apparatus comprising:

an elongated housing having a corona bay therein and a mounting hole passing from the outside of said housing to said corona bay, a corona wire arranged within said corona bay, to extend along the length thereof and over said mounting hole, and a stub member having a head at one end thereof, a shank including a spiral thread thereon at the other end thereof, and a lip intermediate said head and said thread, the distance between said head and said lip being substantially the thickness of said housing as defined by said mounting hole, and the diameter of said shank being substantially the diameter of said mounting hole, said stub member being mounted in said mounting hole such that said head is on the outside of said housing and said lip and thread project into said corona bay, so that said spiral thread engages said corona wire, whereby rotation of said stub member within said mounting hole causes said corona wire to ride said spiral thread and move along said shank.

8. In a corona charging apparatus including a housing and a corona wire adjacent thereto, apparatus for adjusting the position of said corona wire relative to said housing comprising:

a stub member having a shank with a spiral thread thereon, and means for mounting said stub member on said housing, in a rotatable but otherwise fixed position, with said thread engaging said corona wire, whereby rotation of said stub member causes said corona wire to ride said thread and move along said shank.

9. The corona charging apparatus of claim 8 wherein said thread engages one end of said corona wire.

10. The corona charging apparatus of claim 9 wherein said one end of said corona wire is wrapped around the threads of said stub member, whereby said stub member supports said one end of said corona wire.

11. A corona charging apparatus comprising:

a housing having a mounting hole passing therethrough, a corona wire in proximity to said mounting hole, and a stub member having a head and a shank, said shank including a lip and a spiral thread thereon, the distance between said head and said lip being substantially the thickness of said housing as defined by said mounting hole, and the diameter of said shank being substantially the diameter of said mounting hole, said stub member being mounted in said mounting hole so that said thread engages said corona wire, whereby rotation of said stub member within said mounting hole causes said corona wire to ride said thread and move along said shank.

12. An electrophotographic copier having a rotatable photoconductive drum, a corona charging apparatus for charging said drum, an exposure station for generating a latent electrostatic image on said drum, and a toner station disposed about the periphery of said drum for developing the latent electrostatic image, the corona charging apparatus comprising:

a corona housing and a corona wire adjacent thereto, facing the surface of said drum, a stub member having a shank with a spiral thread thereon, and means for mounting said stub member on said housing, in a rotatable but otherwise fixed position, with said spiral thread engaging said corona wire, whereby rotation of said stub member causes said corona wire to ride said spiral thread and move along said shank.

13. A corona charging apparatus having an elongated corona wire and an apparatus for axially moving one end of the corona wire, said apparatus comprising:

a stub member having a shank with a spiral thread thereon, and means for mounting said stub member in a rotatable but otherwise fixed position relative to said corona wire so that said spiral thread engages said wire, whereby rotation of said stub member causes said corona wire to ride said thread and move along said shank.

14. A corona charging apparatus having a housing, a corona wire within said housing, means for fixedly securing one end of said wire and an apparatus for adjustably supporting the other end of said wire, said apparatus comprising:

a stub member having a shank with a spiral thread thereon, and means for mounting said stub member in a rotatable but otherwise fixed position in said housing so that said spiral thread engages said wire, whereby rotation of said stub member causes said corona wire to ride said thread and move parallel to the axis of said shank.

15. A corona charging apparatus comprising:

an elongated housing having a corona bay, a corona wire arranged within said corona bay, to extend along the length thereof, an elongated flexible electrical connector, one end of which is connected to one end of said corona wire, and the other end of which is attached to said housing, a first stub member, having a first shank with a first spiral thread thereon, and first means for mounting said first stub member on said housing, in a rotatable but otherwise fixed position, with said first shank protruding into said corona bay and said first thread engaging one side edge of said elongated flexible electrical connector, whereby rotation of said first stub member causes said elongated flexible electrical connector to ride said first thread and move along said first shank.

16. The corona charging apparatus of claim 15 further comprising:

a coil spring, one end of which is connected to the other end of said corona wire, a second stub member, having a second shank with a second spiral thread thereon and second means for mounting said stub member on said housing in a rotatable but otherwise fixed position, with said second shank protruding into said corona bay and the other end of said coil spring wrapped around said second thread.

whereby rotation of said second stub member causes said other end of said spring to ride said second thread and move along said second shank.

* * * * *